US012434165B2

(12) United States Patent
Freitas

(10) Patent No.: US 12,434,165 B2
(45) Date of Patent: Oct. 7, 2025

(54) DIY MEMORIAL PLUSHY KIT SYSTEM AND METHOD

(71) Applicant: Chasing Haven, LLC, Prairieville, LA (US)

(72) Inventor: Mackenzie Freitas, Prairieville, LA (US)

(73) Assignee: Chasing Haven, LLC, Prarieville, LA (US)

( * ) Notice: Subject to any disclaimer, the term of this patent is extended or adjusted under 35 U.S.C. 154(b) by 189 days.

(21) Appl. No.: 18/405,111

(22) Filed: Jan. 5, 2024

(65) Prior Publication Data

US 2025/0222369 A1 Jul. 10, 2025

(51) Int. Cl.
*A63H 9/00* (2006.01)
*A63H 3/02* (2006.01)
*A63H 3/52* (2022.01)

(52) U.S. Cl.
CPC ..... *A63H 9/00* (2013.01); *A63H 3/02* (2013.01); *A63H 3/52* (2013.01)

(58) Field of Classification Search
CPC ..... A63H 3/02; A63H 3/52; A63H 9/00
See application file for complete search history.

(56) References Cited

U.S. PATENT DOCUMENTS 3,783,554 A * 1/1974 Shapero ..... A63H 3/365 446/87
4,168,592 A * 9/1979 Merino ..... A63H 3/52 434/396
4,297,153 A * 10/1981 Erickson ..... B29C 41/18 446/268
5,186,673 A * 2/1993 Fogarty ..... A63H 3/52 446/268
5,515,592 A * 5/1996 Mills ..... A63H 9/00 446/385
5,746,639 A * 5/1998 Bloom ..... A63H 3/52 446/369
6,227,930 B1 * 5/2001 Norman ..... A63H 3/52 446/376
7,308,741 B1 12/2007 Rydberg et al.
11,007,449 B2 * 5/2021 Chen ..... A63H 3/52
2014/0295730 A1 * 10/2014 Gauci ..... A63H 9/00 446/369
2017/0239583 A1 * 8/2017 Weinshanker ..... A63H 3/36
2018/0280818 A1 * 10/2018 Caplan ..... A41D 27/08
2022/0355214 A1 11/2022 Mapp

* cited by examiner

*Primary Examiner* — John A Ricci
(74) *Attorney, Agent, or Firm* — Lemler IP, LLC; Thomas E. Lemler

(57) ABSTRACT

A DIY memorial plushy kit system and method for memorializing a deceased loved one is provided. The kit system containing a plushy stuffed animal, a customizable plushy accessory comprising a removable protective paper liner covering a heat activated permanent double-sided adhesive on an accessory front surface of the customizable plushy accessory, a personalization template substantially formed to a shape of the customizable plushy accessory, and a cutting tool used to form a pattern piece from a garment of a deceased loved one. In one embodiment, the plushy stuffed animal includes a weighted interior material adapted to provide anxiety relief to a bereaved loved one. In another embodiment, the steps of a method of creating a DIY customized memorial plushy stuffed animal is presented.

19 Claims, 11 Drawing Sheets

DIY MEMORIAL PLUSHY KIT SYSTEM AND METHOD

BACKGROUND OF THE INVENTION

The present invention pertains to a do-it-yourself (DIY) memorial plushy kit system and method for memorializing a deceased loved one to honor the deceased loved one while providing comfort to a bereaved person by keeping the memory of the deceased loved one alive. The present invention further pertains to a kit system containing a plushy stuffed animal, a customizable plushy accessory comprising a removable protective paper liner covering a heat activated permanent double-sided adhesive on an accessory front surface of the customizable plushy accessory, a personalization template substantially formed to a shape of the customizable plushy accessory, and a cutting tool used to form a pattern piece from a garment of a deceased loved one, as well as a method of accomplishing the same.

DESCRIPTION OF THE RELATED ART

The loss of a loved one causes great pain and anxiety in individuals experiencing bereavement. Often the bereaved individual is left with a feeling of emptiness at the loss of the loved one. Having an emotionally satisfying way to memorialize and honor a deceased loved one is an extremely important way of processing such a loss. The additional ability to keep a piece of the deceased loved one alive with the added benefit of getting anxiety relief is an excellent way of processing bereavement as well as being able to hold onto the memory of the deceased loved one.

Memorial products have been available in the market for quite some time. Existing memorial products are available in a multitude of various shapes, sizes, and formats, which have the basic utility of preserving the memory of a deceased loved one. Some memorial products are designed to be left at the grave of the deceased, while others are meant to be kept on a mantle or shelves of the bereaved individual.

Many people find comfort and a sense of security in cuddling or sleeping with a stuffed animal. The texture and familiarity of a plushy stuffed animal can help create a soothing and calming environment for sleep or times that individuals may experience struggles with anxiety, depression, and/or insomnia. The ability to get back to sense of "normalcy" is an important step for bereaved individuals who may be experiencing anxiety and/or depression as a result of the loss of a loved one. It is the goal of the present invention to utilize the benefits of plushy stuffed animals while providing the ability to incorporate a part of a deceased loved one's memory into a product that honors the deceased loved one while providing relief and a sense of safety for the bereaved individual.

U.S. Patent Application Publication 2022/0355214 A1 discloses a weatherproof stuffed animal for placement on gravesites and external memorial sites. The stuffed animal can be placed by a person at a gravesite (or memorial site) as a memorial for a person who has passed away. The stuffed animal includes a weatherproof outer cover and inner filling. The weatherproof properties prohibit the stuffed animal from becoming tattered and deteriorated in harsh weather elements. The stuffed animal also can include customized mourning/remembrance messages on the outer cover for mourning. Additionally disclosed, the stuffed animal can have LEDs to illuminate the remembrance messages and can also have a protective slot for securing a name, a message, and/or a photo of the person on whose gravesite the stuffed animal is kept.

U.S. Pat. No. 7,308,741 B1 discloses a system for storing cremated remains in one or more holders that an individual may physically hold onto. The cremated remains storage system incorporates a "plush container" that incorporates ornamental symbols associated with a deceased individual's life while keeping the cremated remains of the deceased individual inside of a pocket of the stuffed animal.

All aforementioned patents and publications are incorporated herein by reference.

While these devices may be suitable for the particular purpose employed, they would not be as suitable, or suitable at all, for the purposes of the present invention as disclosed hereafter.

While the prior art discloses various devices and apparatuses for memorializing the deceased, the present invention implements the use of a system that helps a bereaved individual to work through their grief and improve the mental health of the individual by utilizing the therapeutic aspects of crafts projects while including a portion of a deceased loved one's clothing in a healthy manner. Additionally, the invention disclosed herein provides the advantage of having a comforting plushy stuffed animal that incorporates a memory of the deceased loved one by utilizing a piece of an article of clothing of the deceased loved one on the cuddly plushy stuffed animal to help the bereaved individual deal with feelings of anxiety, depression, and loneliness.

SUMMARY OF THE INVENTION

It is one prospect of the present invention to provide a novel system for memorializing a deceased loved one by way of utilizing a convenient do-it-yourself plushy kit along with an article of the deceased loved one's clothing to honor the deceased loved one while providing comfort to a bereaved person by keeping the memory of the deceased loved one alive.

The following presents a simplified summary of the present disclosure in a simplified form as a prelude to the more detailed description that is presented herein.

Therefore, in accordance with a preferred embodiment of the present invention, there is provided a DIY memorial kit system. The DIY memorial kit system includes at least one plushy stuffed animal that has an outer shell material and an inner stuffing material. Included within the DIY memorial kit system is at least one customizable plushy accessory, which has an accessory front surface that includes a first end section. The accessory front surface is located opposite an accessory back surface that includes a second end section. The at least one customizable plushy accessory has at least one frontside adhesive material that is attached to the first end section of the accessory front surface and at least one backside adhesive material that is attached to the second end section of the accessory back surface. The at least one backside adhesive material is designed to receive and retain the at least one frontside adhesive material whereby the at least one customizable plushy accessory is designed to wrap around the at least one plushy stuffed animal. In accordance with the present invention, the DIY memorial kit system requires at least one garment of a deceased loved one provided by the bereaved person as well as a pen that is also provided by bereaved person that is designed to place markings on the at least one garment of the deceased loved one. The DIY memorial kit system includes at least one personalization template that is amply formed to a shape of the at least one customizable plushy accessory and a cutting tool that is designed for shearing the at least one garment of the deceased loved one is also provided. The at least one garment of the deceased loved one forms at least one pattern piece in the shape of the at least one customizable plushy accessory when sheared with the cutting tool. In accordance with the present invention, the accessory front surface of the at least one customizable accessory includes a removable protective paper liner that covers a heat activated permanent double-sided adhesive. The heat activated permanent double-sided adhesive is designed to receive and retain the at least one pattern piece when the at least one customizable plushy accessory and the at least one pattern piece are exposed to heat and pressure.

In one embodiment, the outer shell material of the at least one plushy stuffed animal is made of at least one of or a combination of the materials that include weatherproof and tear resistant material, felt, mohair, faux fur, cotton, fleece, corduroy, canvas, and jeans.

In another embodiment, the inner stuffing material is made out of at least one of or a combination of materials that include cotton, wool, down, beads, plastic pellets, beans, synthetic fiber, and bamboo fibers.

In yet another embodiment, the DIY memorial kit system further includes a weighted interior material designed to provide anxiety relief to the bereaved person by increasing the weight of the at least one plushy stuffed animal. In accordance with such embodiment of the present invention the weighted interior material is evenly distributed within the at least one plushy stuffed animal and is made of at least one of or a combination of materials that include glass beads, plastic pellets, rice, buckwheat, and beans.

In one embodiment, the DIY memorial kit system further includes a weighted interior material designed to provide anxiety relief to the bereaved person by increasing the weight of the at least one plushy stuffed animal. In accordance with such embodiment of the invention, the weighted interior material is contained in at least one bag that is sewn onto an interior surface of the outer shell material. The weighted interior material contained in the at least one bag is made of at least one of or a combination of materials that include glass beads, plastic pellets, rice, buckwheat, sand, and beans.

In another embodiment, the at least one customizable plushy accessory is an accessory that is optionally either a bandana bib, vest, dress, pants, skirt, shirt, jacket, scarf, hat, headband, or mask.

In yet another embodiment, the at least one backside adhesive material and the at least one frontside adhesive material are made of either Velcro®, double sided adhesive glue, snap buttons, or hook-and-loop fasteners.

In one embodiment, the heat activated permanent double-sided adhesive is made of at least one of or a combination of chemical components that include polyethylene terephthalate (PET), polyethylene vinyl acetate (EVA), polyamide (nylon), natural resins, synthetic resins, waxes, calcium carbonate, talc, silica, butylated hydroxytoluene (BHT), and butylated hydroxyanisole (BHA).

In another preferred embodiment of the invention, a DIY memorial kit system is presented. The DIY memorial kit system includes at least one plushy stuffed animal made of an outer shell material and an inner stuffing material. The DIY memorial kit system includes at least one customizable plushy accessory that has an accessory front surface oriented opposite an accessory back surface. Included is at least one frontside adhesive material located on a plushy front surface of the at least one plushy stuffed animal and at least one backside adhesive material located on the backside of the accessory back surface. The at least one backside adhesive material is designed to receive and retain the at least one frontside adhesive material and the at least one customizable plushy accessory, which is designed to attach to the at least one plushy stuffed animal. In accordance with such preferred embodiment of the present invention, at least one garment of a deceased loved one is provided by a bereaved person along with a pen that is designed to place markings on the at least one garment of the deceased loved one. The DIY memorial kit system includes at least one personalization template that is largely formed in the shape of the at least one customizable plushy accessory and a cutting tool that is designed for shearing the at least one garment of the deceased loved one. The at least one garment of the deceased loved one forms at least one pattern piece that is in the shape of the at least one customizable plushy accessory when sheared with the cutting tool. In accordance with the present invention, the accessory front surface includes a removable protective paper liner that covers a heat activated permanent double-sided adhesive, which is designed to receive and retain the at least one pattern piece when the at least one customizable plushy accessory and the at least one pattern piece are exposed to heat and pressure.

In one embodiment, the outer shell material of the at least one plushy stuffed animal is made of at least one of or a combination of the materials that include weatherproof and tear resistant material, felt, mohair, faux fur, cotton, fleece, corduroy, canvas, and jeans.

In another embodiment, the inner stuffing material is made out of at least one of or a combination of materials that include cotton, wool, down, beads, plastic pellets, beans, synthetic fiber, and bamboo fibers.

In yet another embodiment, the DIY memorial kit system further includes a weighted interior material designed to provide anxiety relief to the bereaved person by increasing the weight of the at least one plushy stuffed animal. In accordance with such embodiment of the present invention the weighted interior material is evenly distributed within the at least one plushy stuffed animal and is made of at least one of or a combination of materials that include glass beads, plastic pellets, rice, buckwheat, and beans.

In one embodiment, the DIY memorial kit system further includes a weighted interior material designed to provide anxiety relief to the bereaved person by increasing the weight of the at least one plushy stuffed animal. In accordance with such embodiment of the invention, the weighted interior material is contained in at least one bag that is sewn onto an interior surface of the outer shell material. The weighted interior material contained in the at least one bag is made of at least one of or a combination of materials that include glass beads, plastic pellets, rice, buckwheat, sand, and beans.

In another embodiment, the at least one customizable plushy accessory is an accessory that is optionally either a flower, star, square, rectangle, circle, oval, triangle, or heart.

In yet another embodiment, the at least one backside adhesive material and the at least one frontside adhesive material are made of either Velcro®, double sided adhesive glue, snap buttons, or hook-and-loop fasteners.

In one embodiment, the heat activated permanent double-sided adhesive is made of at least one of or a combination of chemical components that include polyethylene terephthalate (PET), polyethylene vinyl acetate (EVA), polyamide (nylon), natural resins, synthetic resins, waxes, calcium carbonate, talc, silica, butylated hydroxytoluene (BHT), and butylated hydroxyanisole (BHA).

Therefore, in accordance with yet another preferred embodiment of the invention, a method of creating a DIY customized memorial plushy stuffed animal is presented. The method of creating a DIY customized memorial plushy stuffed animal includes step a) receiving a DIY customized memorial plushy stuffed animal kit. The DIY customized memorial plushy stuffed animal kit includes a plushy stuffed animal, a customizable plushy accessory including a removable protective paper liner that covers a heat activated permanent double-sided adhesive on an accessory front surface of the customizable plushy accessory, a personalization template that is significantly formed in the shape of the customizable plushy accessory, and a cutting tool.

The method includes a step b) of selecting a garment of a deceased loved one for personalization that can safely be ironed followed by a step c) of identifying a usable area of the garment which does not exhibit significant signs of wear or staining and does not include seams, buttonholes, or hardware.

In accordance with the present method, the method includes a step d) of spreading the usable area of the garment of a deceased loved one over a flat surface, then a step e) of removing wrinkles from the usable area of the garment of a deceased loved one by smoothing the usable area of the garment of a deceased loved one on the flat surface, and then a step f) of placing the personalization template carefully and firmly on top of the usable area of the garment of a deceased loved one. A step g) of drawing markings on the usable area of the garment of a deceased loved one using a pen that is provided by the bereaved person by trace around the outer edges of the personalization template, followed by a step h) removing the personalization template from the usable area of the garment of a deceased loved one, then a step i) of verifying the visibility of the markings on the usable area of the garment of a deceased loved one, and a step j) of grasping an outermost fabric layer of the usable area of the garment of a deceased loved one.

The method then includes a step k) of cutting along the markings on the usable area of the garment of a deceased loved one with the cutting tool to form a pattern piece, then a step l) of removing the customizable plushy accessory from the plushy stuffed animal, followed by a step m) of spreading the customizable plushy accessory on a flat heat resistant surface, and a step n) removing and discarding the removable protective paper liner from the accessory front surface. In accordance with the present invention, the method includes a step o) of placing the pattern piece face up on top of the accessory front surface, followed by a step p) of lining up the pattern piece on top of the customizable plushy accessory to cover the entire area once covered by the protective liner, then a step q) of preheating an iron to medium heat without the use of steam, and a step r) of placing the preheated iron over the pattern piece lined up with the customizable plushy accessory for at least 5 seconds.

The method then includes a step s) of ironing the pattern piece lined up with the customizable plushy accessory in a circular motion for at least 5 seconds, then a step t) of allowing the ironed pattern piece lined up with the customizable plushy accessory to cool briefly for at least 30 seconds, and a step u) of flipping the pattern piece lined up with the customizable plushy accessory on top of the flat heat resistant surface. The method then includes a step v) of ironing in a circular motion using firm pressure on the customizable plushy accessory lined up with the pattern piece for at least six to eight seconds until the customizable plushy accessory and the pattern piece are securely bonded, followed by a step w) of confirming that the customizable plushy accessory and the pattern piece are securely bonded.

The method includes a step x) of flipping the customizable plushy accessory securely bonded to the pattern piece over, and finally a step y) of attaching the customizable plushy accessory securely bonded to the pattern piece to the plushy stuffed animal.

In one embodiment, the at least one customizable plushy accessory is an accessory that is optionally either a bandana bib, vest, dress, pants, skirt, shirt, jacket, scarf, hat, headband, or mask.

In another embodiment, the at least one customizable plushy accessory is an accessory that is optionally either a flower, star, square, rectangle, circle, oval, triangle, or heart.

BRIEF DESCRIPTION OF THE DRAWINGS

Illustrative embodiments of the present invention are described herein with reference to the accompanying drawings, in which.

DETAILED DESCRIPTION

For a further understanding of the nature and function of the embodiments, reference should be made to the following detailed description. Detailed descriptions of the embodiments are provided herein, as well as, the best mode of carrying out and employing the present invention. It will be readily appreciated that the embodiments are well adapted to carry out and obtain the ends and features mentioned as well as those inherent herein. It is to be understood, however, that the present invention may be embodied in various forms. Therefore, persons of ordinary skill in the art will realize that the following disclosure is illustrative only and not in any way limiting, as the specific details disclosed herein provide a basis for the claims and a representative basis for teaching to employ the present invention in virtually any appropriately detailed system, structure, or manner. It should be understood that the devices, materials, methods, procedures, and techniques described herein are presently representative of various embodiments. Other embodiments of the disclosure will readily suggest themselves to such skilled persons having the benefit of this disclosure.

Referring initially to FIGS. 1-4, the basic constructional details and principles of operation of a DIY memorial kit system 100 according to a preferred embodiment of the present invention will be discussed.

Figure 1:
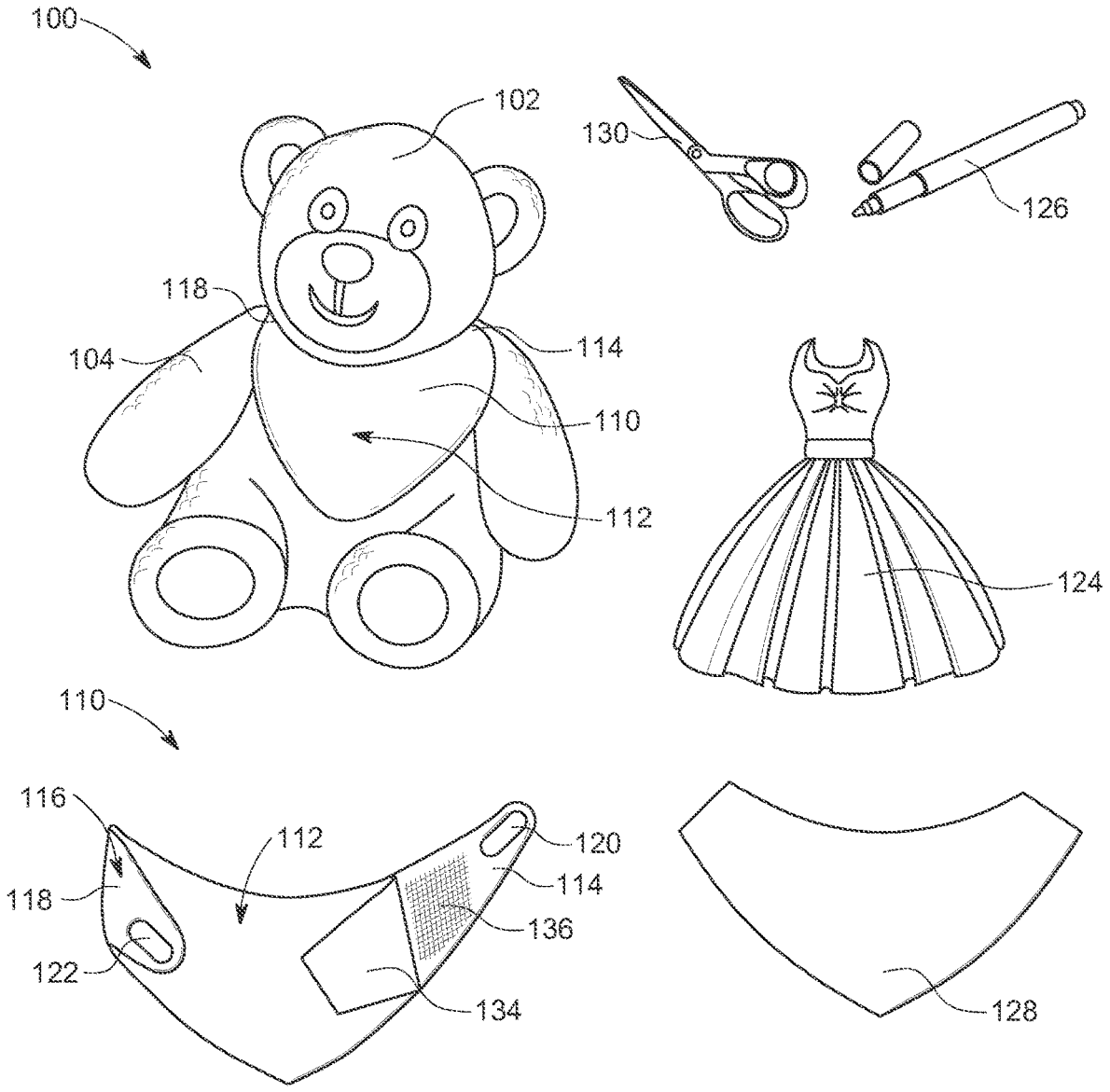
FIG. 1 is a front elevation view of a DIY memorial kit system, according to a preferred embodiment of the present invention.
Figure 3:
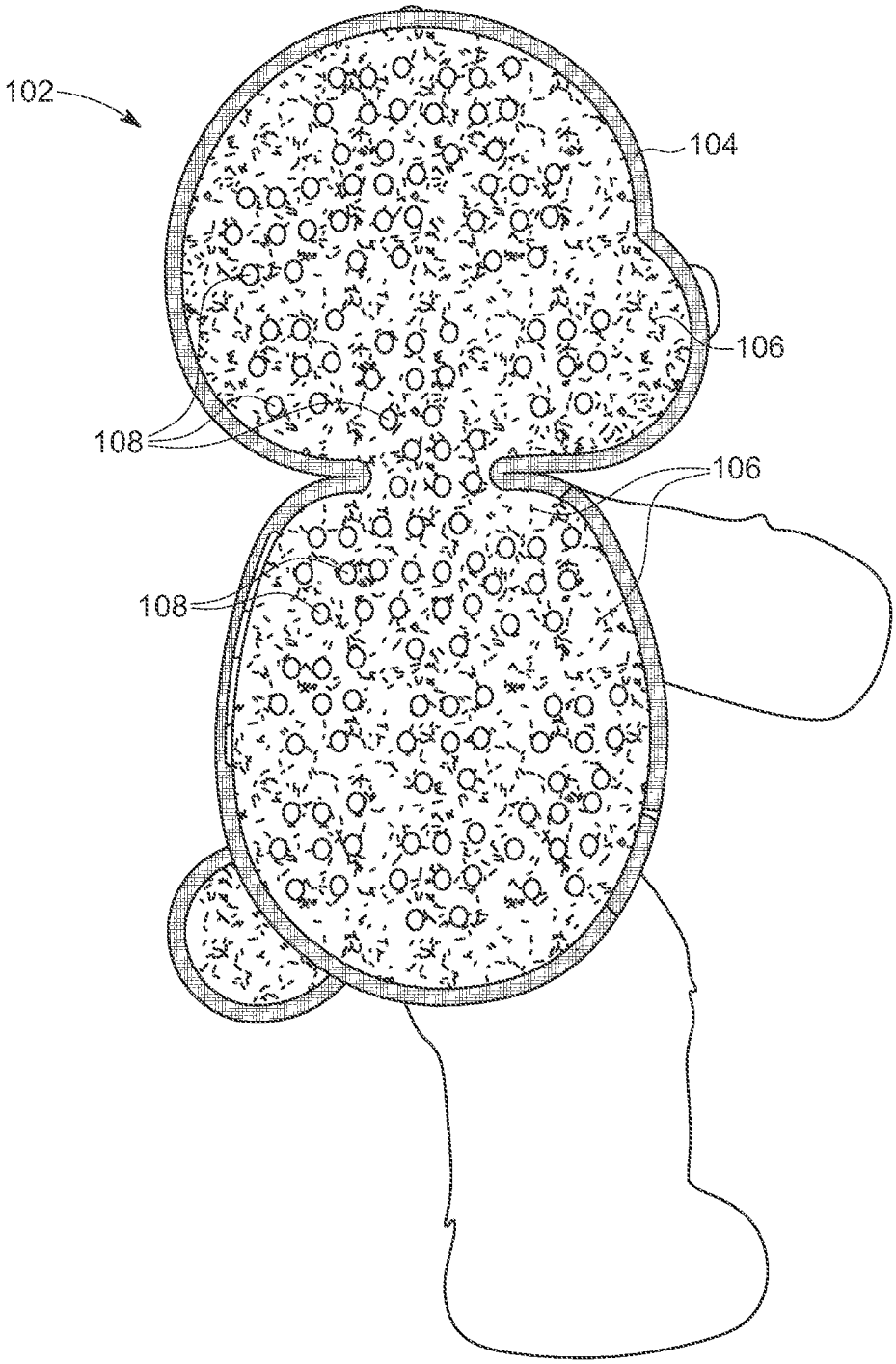
FIG. 3 is a right-side cross-sectional elevation view of at least one plushy stuffed animal, showing a weighted interior material evenly distributed, according to an embodiment of the present invention.
Figure 4:
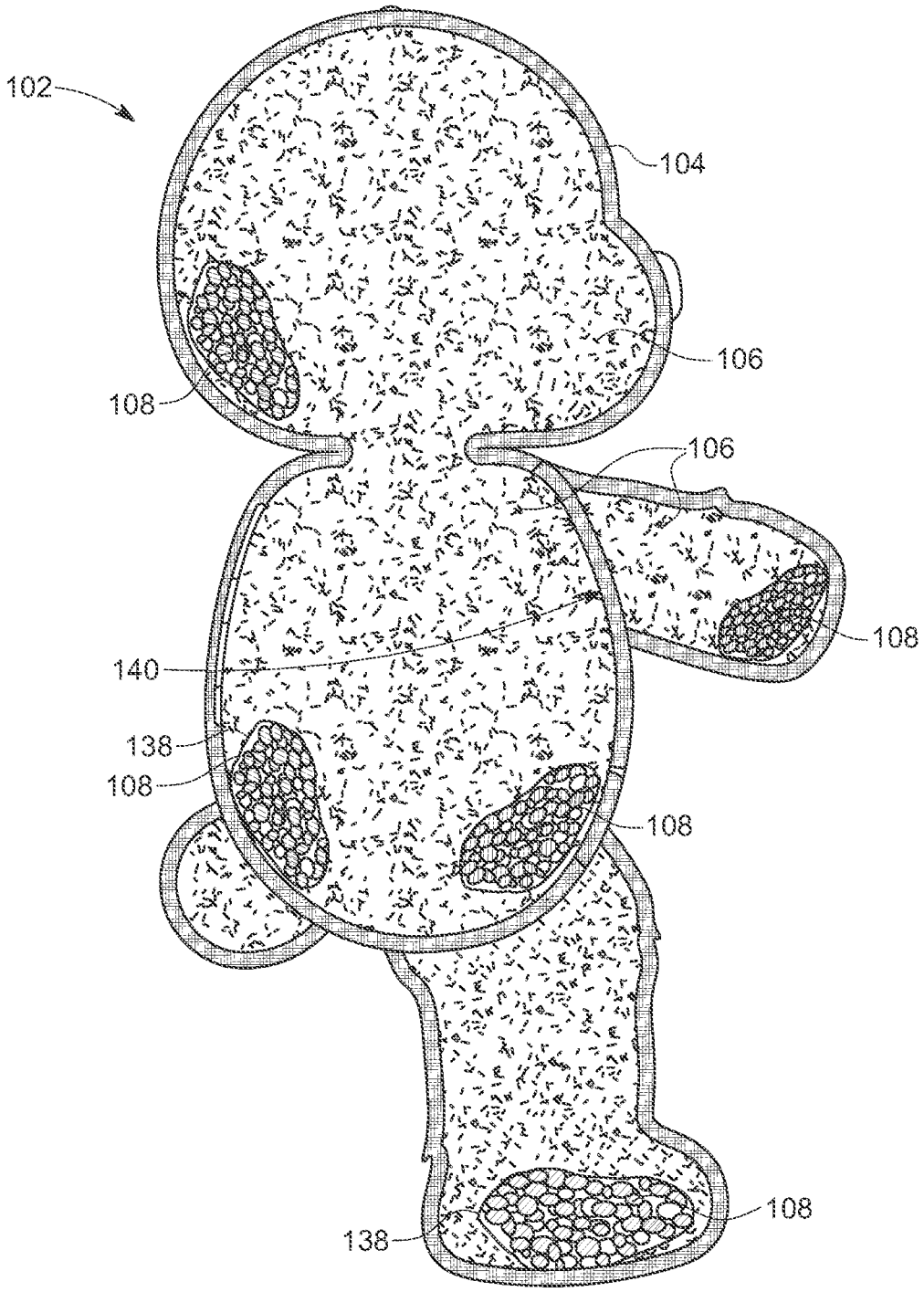
FIG. 4 is a right-side cross-sectional elevation view of at least one plushy stuffed animal, showing a weighted interior material contained in at least one bag, according to an embodiment of the present invention.

FIG. 1 illustrates a preferred embodiment of the DIY memorial kit system 100. The DIY memorial kit system 100 includes at least one plushy stuffed animal 102 that has an outer shell material 104 and an inner stuffing material 106, as illustrated in FIGS. 3-4. As an exemplary illustration of the present invention, the at least one plushy stuffed animal 102 is depicted as a teddy bear such as that depicted in FIGS. 1-4, however it would be apparent to one skilled in the relevant art that the at least one plushy stuffed animal 102 can be presented in various forms such as a koala, dinosaur, mouse, real and mythical animals, etc.

Figure 2A:
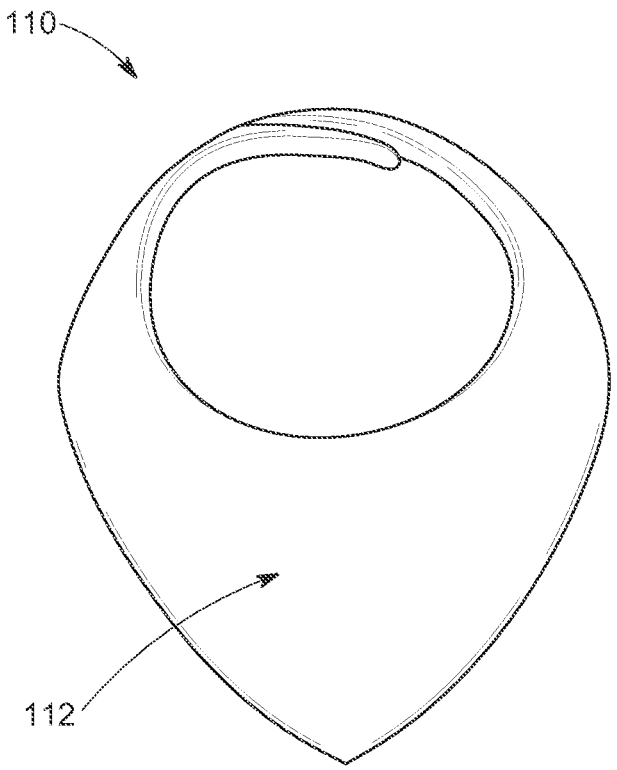
FIG. 2A is a top perspective view of at least one customizable plushy accessory, according to a preferred embodiment of the present invention.
Figure 2B:
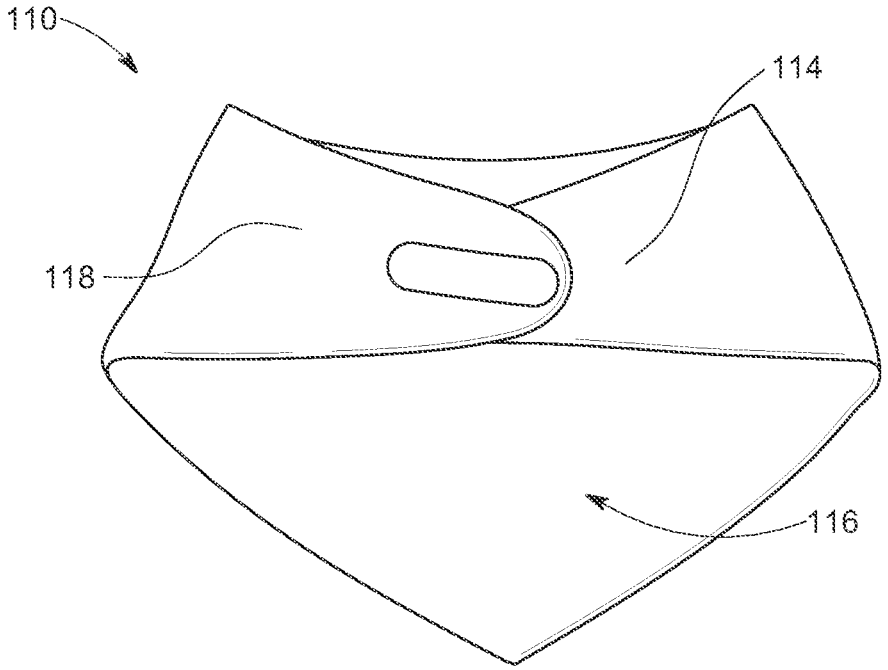
FIG. 2B is a back elevation view thereof, according to a preferred embodiment of the present invention.
Figure 2C:
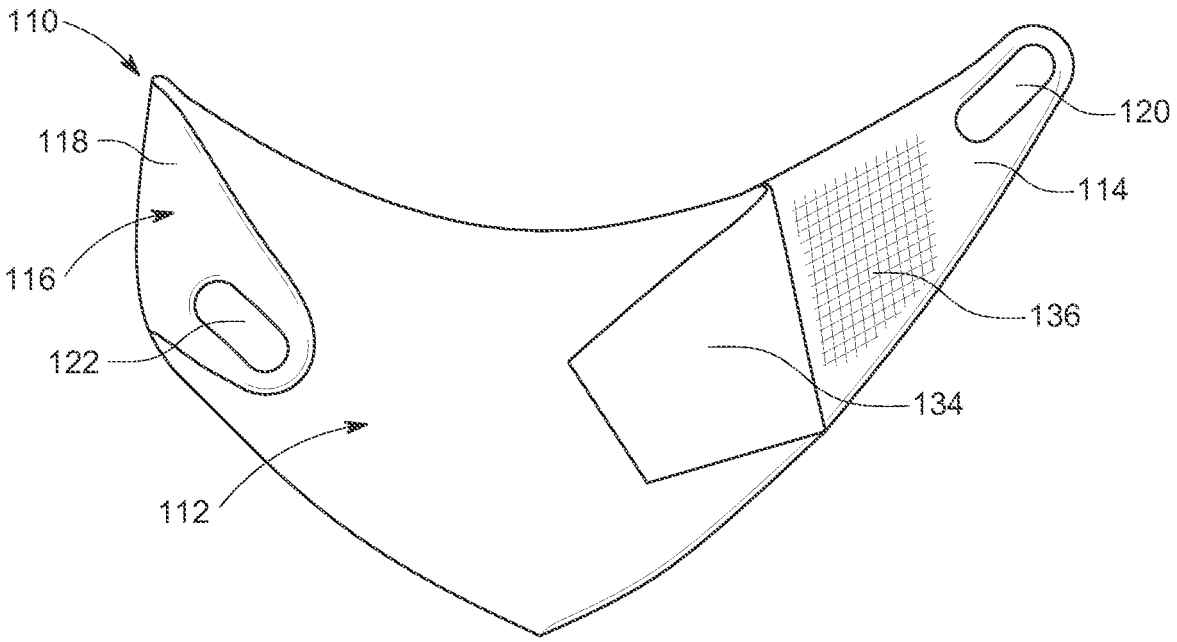
FIG. 2C is a front elevation view thereof, showing a removable protective paper liner covering a heat activated permanent double-sided adhesive, according to a preferred embodiment of the present invention.
Figure 2D:
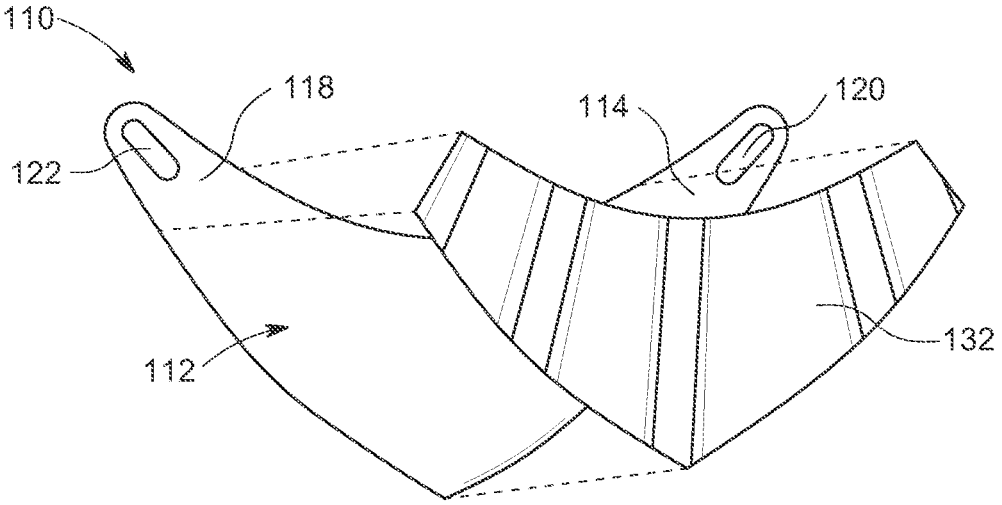
FIG. 2D is a front right exploded perspective view of at least one customizable plushy accessory and at least one pattern piece, according to a preferred embodiment of the present invention.

Included within the DIY memorial kit system 100 is at least one customizable plushy accessory 110, shown in FIGS. 1-2D, which has an accessory front surface 112 that includes a first end section 114. The accessory front surface 112 is located opposite an accessory back surface 116 that includes a second end section 118. As illustrated in FIGS. 1, 2C, and 2D, the at least one customizable plushy accessory 110 has at least one frontside adhesive material 120 that is attached to the first end section 114 of the accessory front surface 112 and at least one backside adhesive material 122 that is attached to the second end section 118 of the accessory back surface 116. The at least one backside adhesive material 122 is designed to receive and retain the at least one frontside adhesive material 120, as illustrated in FIGS. 2A-2B, whereby the at least one customizable plushy accessory 110 is designed to wrap around the at least one plushy stuffed animal 102.

In accordance with the present invention, turning back to FIG. 1, the DIY memorial kit system 100 requires at least one garment of a deceased loved one 124 provided by the bereaved person as well as a pen 126 that is also provided by the bereaved person, the pen 126 is designed to place markings on the at least one garment of the deceased loved one 124. The DIY memorial kit system 100 includes at least one personalization template 128, as shown in FIG. 1, that is amply formed to a shape of the at least one customizable plushy accessory 110 and a cutting tool 130 that is designed for shearing the at least one garment of the deceased loved one 124 is also provided. The at least one garment of the deceased loved 124 one forms at least one pattern piece 132, as illustrated in FIG. 2D, in the shape of the at least one customizable plushy accessory 110 when sheared with the cutting tool 130.

In accordance with the present invention, illustrated in FIGS. 1 and 2C, the accessory front surface 112 of the at least one customizable accessory 110 includes a removable protective paper liner 134 that covers a heat activated permanent double-sided adhesive 136. The heat activated permanent double-sided adhesive 136 is designed to receive and retain the at least one pattern piece 132 when the at least one customizable plushy accessory 110 and the at least one pattern piece 132 are exposed to heat and pressure, shown in FIG. 2D.

In one embodiment, the outer shell material 104 of the at least one plushy stuffed animal 102, shown in FIGS. 3-4, is made of at least one of or a combination of the materials that include weatherproof and tear resistant material, felt, mohair, faux fur, cotton, fleece, corduroy, canvas, and jeans. Such options would be available as options upon purchase of the DIY memorial kit system 100.

In another embodiment, the inner stuffing material 106 is made out of at least one of or a combination of materials that include cotton, wool, down, beads, plastic pellets, beans, synthetic fiber, and bamboo fibers. Similarly, such options would be available as options upon purchase of the DIY memorial kit system 100.

Turning to FIG. 3, yet another embodiment of the present invention is disclosed, whereby the DIY memorial kit system 100 further includes a weighted interior material 108 designed to provide anxiety relief to the bereaved person by increasing the weight of the at least one plushy stuffed animal 102. In accordance with such embodiment of the present invention, the weighted interior material 108 is evenly distributed within the at least one plushy stuffed animal 102, providing anxiety relieving effects similar to those provided by weighted blankets. The weighted interior material 108 is made of at least one of or a combination of materials that include glass beads, plastic pellets, rice, buckwheat, and beans.

In one embodiment, as shown in FIG. 4, the DIY memorial kit system 100 further includes a weighted interior material 108 designed to provide anxiety relief to the bereaved person by increasing the weight of the at least one plushy stuffed animal 102. In accordance with such embodiment of the invention, the weighted interior material 108 is contained in at least one bag 138 that is sewn onto an interior surface 140 of the outer shell material 104. This provides a way of increasing the weight of the at least one plushy stuffed animal 102 in specific locations of the at least one plushy stuffed animal 102, which provides additional comfort to the bereaved person when cuddling with the at least one plushy stuffed animal 102. The weighted interior material 108 contained in the at least one bag 138 is made of at least one of or a combination of materials that include glass beads, plastic pellets, rice, buckwheat, sand, and beans.

In another embodiment, the at least one customizable plushy accessory 110 is an accessory that is optionally either a bandana bib, vest, dress, pants, skirt, shirt, jacket, scarf, hat, headband, or mask. As an exemplary illustration of the present invention, the at least one customizable plushy accessory 110 is depicted as a bandana bib such as that depicted in FIGS. 1-2D, however it would be apparent to one skilled in the relevant art that the at least one customizable plushy accessory 110 can be presented in various forms such as those presented above.

In yet another embodiment, shown in FIGS. 1, 2C, and 2D, the at least one backside adhesive material 122 and the at least one frontside adhesive material 120 are made of either Velcro®, double sided adhesive glue, snap buttons, or hook-and-loop fasteners.

In one embodiment, the heat activated permanent double-sided adhesive 136, as shown in FIGS. 1 and 2C, is made of at least one of or a combination of chemical components that include polyethylene terephthalate (PET), polyethylene vinyl acetate (EVA), polyamide (nylon), natural resins, synthetic resins, waxes, calcium carbonate, talc, silica, butylated hydroxytoluene (BHT), and butylated hydroxyanisole (BHA).

Figure 5:
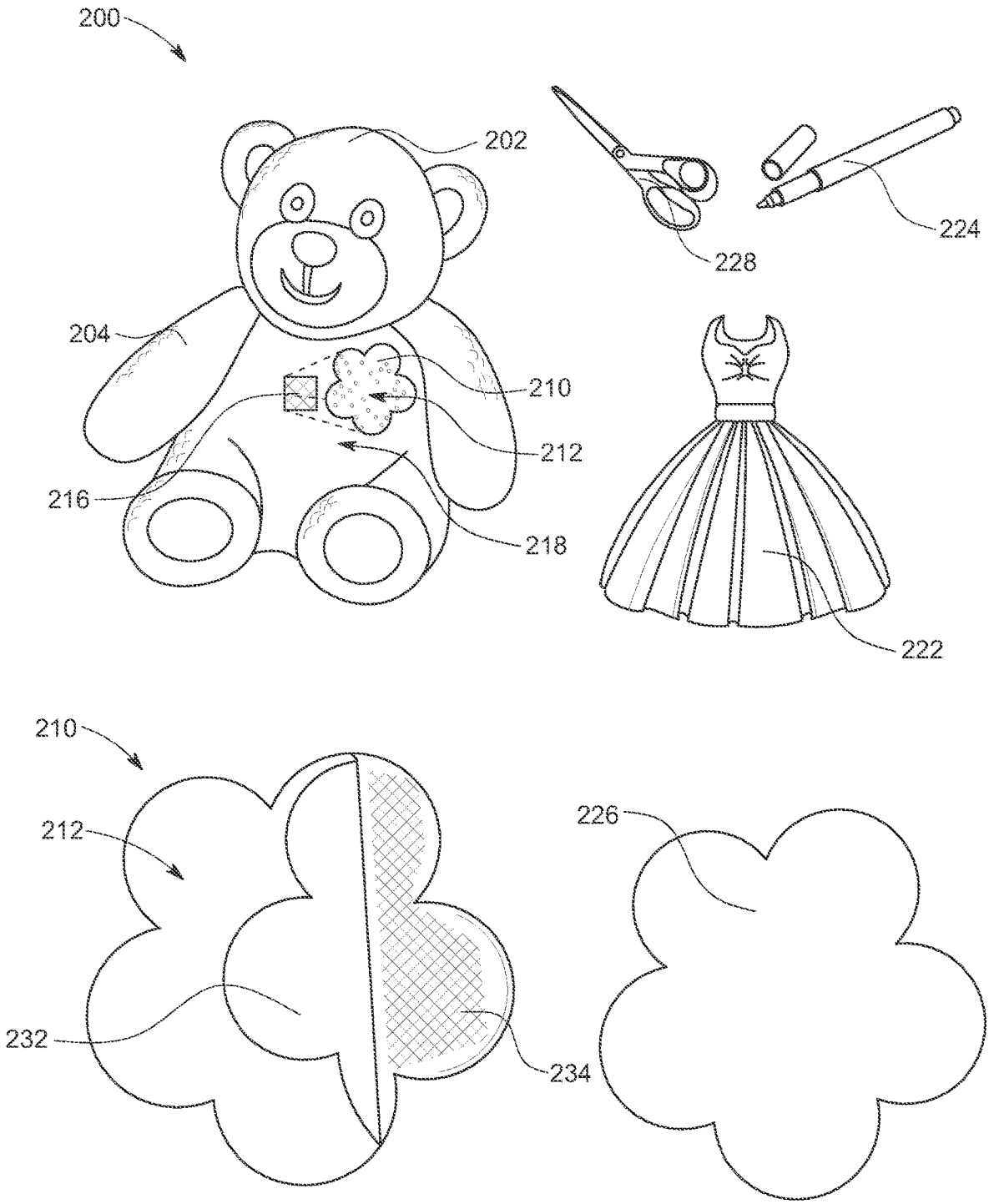
FIG. 5 is a front elevation view of a DIY memorial kit system, according to another preferred embodiment of the present invention.
Figure 6A:
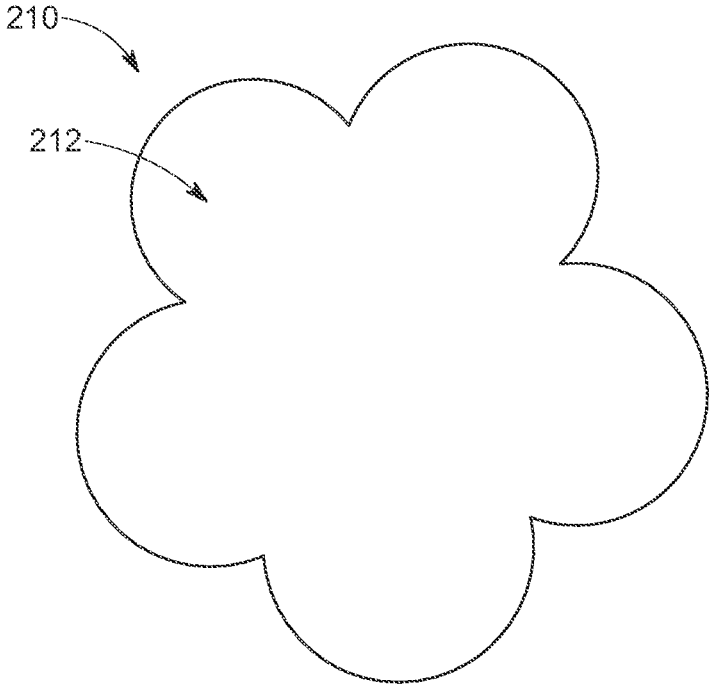
FIG. 6A is a front elevation view of at least one customizable plushy accessory, according to a preferred embodiment of the present invention.
Figure 6B:
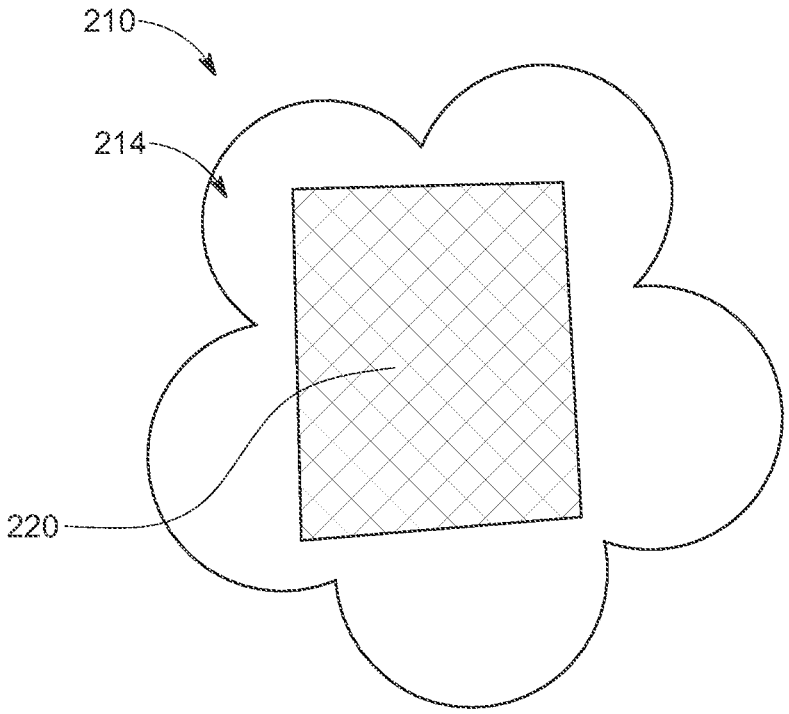
FIG. 6B is a back elevation view thereof, in accordance with preferred embodiments of the present invention.
Figure 6C:
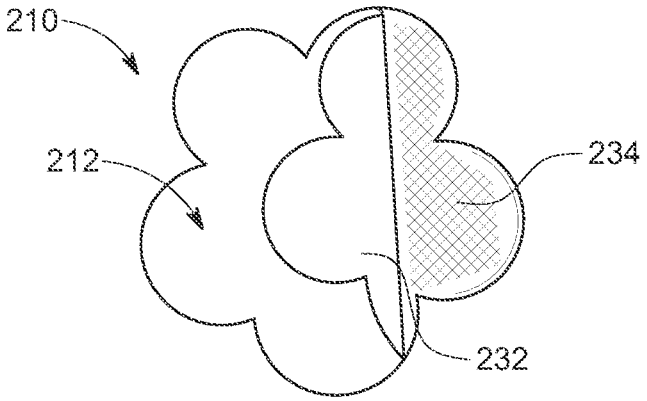
FIG. 6C is a front elevation view thereof, showing a removable protective paper liner covering a heat activated permanent double-sided adhesive, according to a preferred embodiment of the present invention.
Figure 6D:
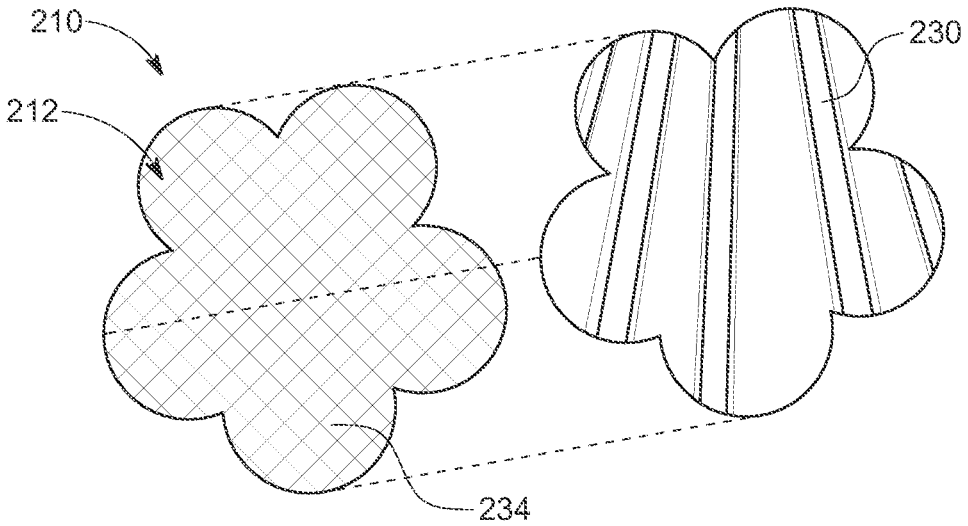
FIG. 6D is a front right exploded perspective view of at least one customizable plushy accessory and at least one pattern piece, according to a preferred embodiments.
Figure 7:
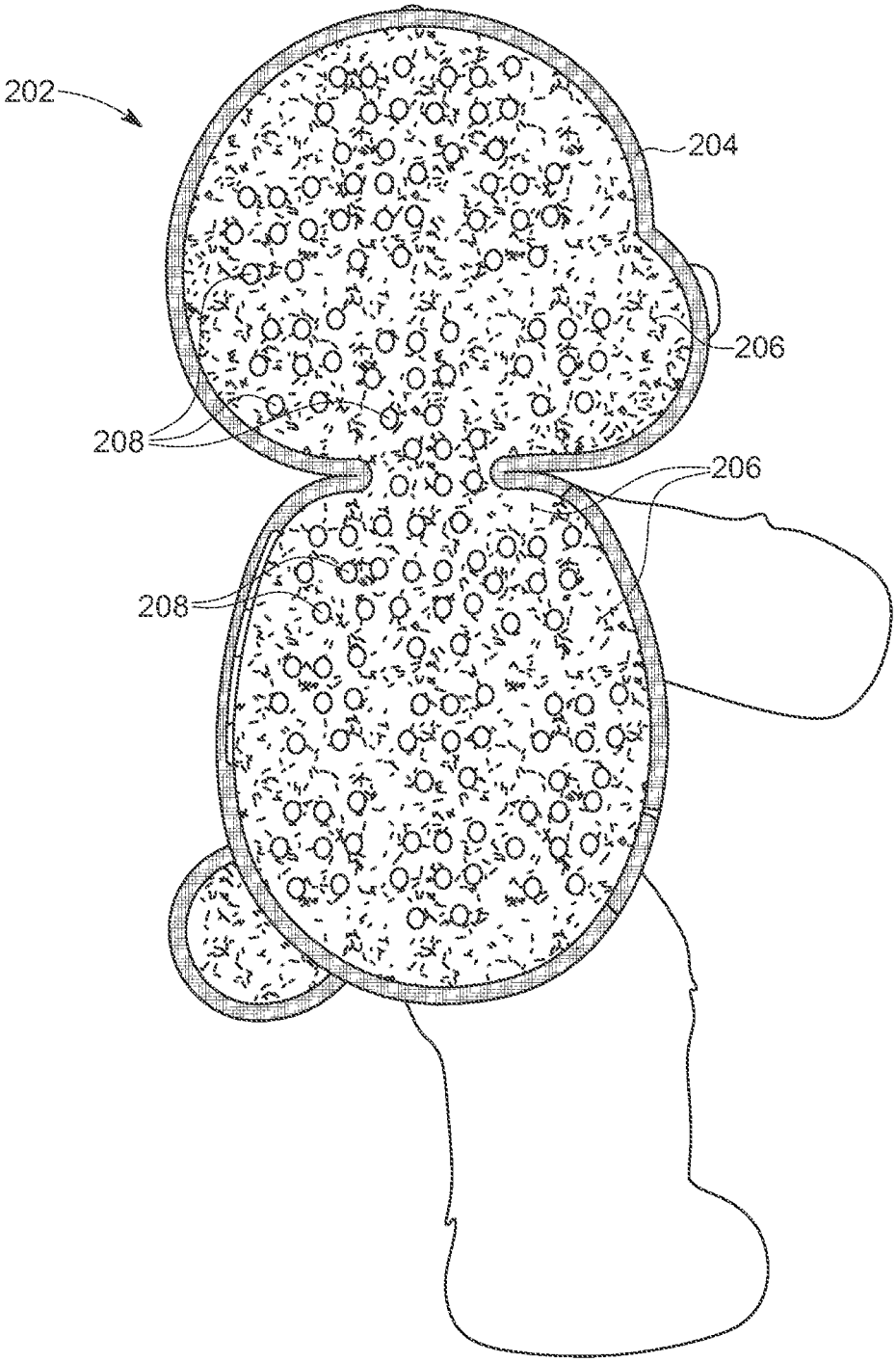
FIG. 7 is a right-side cross-sectional elevation view of at least one plushy stuffed animal, showing a weighted interior material evenly distributed, according to an embodiment of the present invention.
Figure 8:
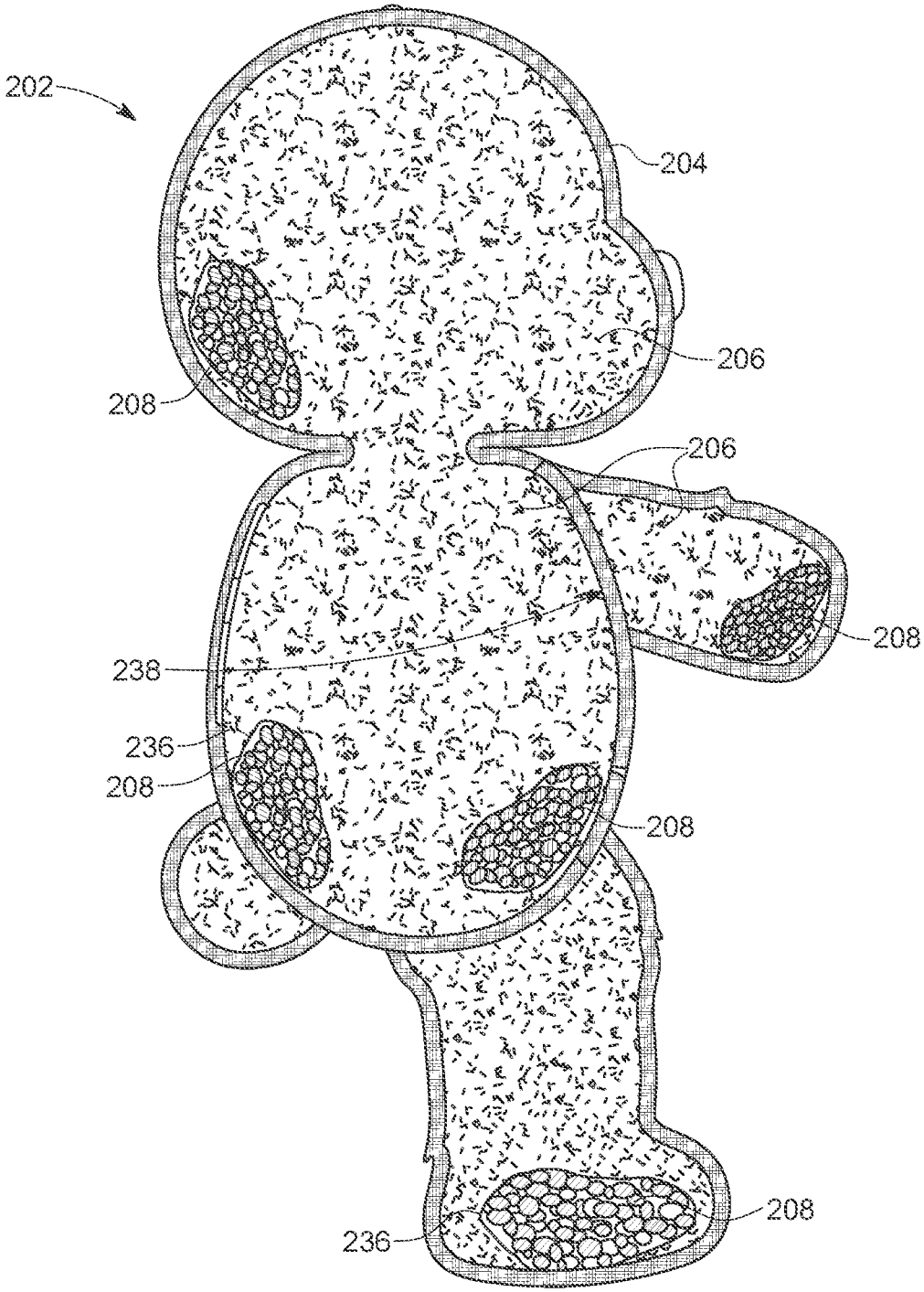
FIG. 8 is a right-side cross-sectional elevation view of at least one plushy stuffed animal, showing a weighted interior material contained in at least one bag, according to an embodiment of the present invention.

Now turning to FIGS. 5-8, in accordance with another preferred embodiment of the present invention, there is provided a DIY memorial kit system 200. As illustrated in FIG. 5, the DIY memorial kit system 200 includes at least one plushy stuffed animal 202 made of an outer shell material 204 and an inner stuffing material 206, as shown in FIGS. 7 and 8. As an exemplary illustration of the present invention, the at least one plushy stuffed animal 202 is depicted as a teddy bear such as that depicted in FIGS. 5-8, however it would be apparent to one skilled in the relevant art that the at least one plushy stuffed animal 202 can be presented in various forms such as a koala, dinosaur, mouse, real and mythical animals, etc.

The DIY memorial kit system 200 includes at least one customizable plushy accessory 210, illustrated in FIGS. 5-6D, that has an accessory front surface 212 oriented opposite an accessory back surface 214. As illustrated in FIG. 5, included is at least one frontside adhesive 216 material located on a plushy front surface 218 of the at least one plushy stuffed animal 202 and as shown in FIG. 6B at least one backside adhesive material 220 is located on the backside of the accessory back surface 214. The at least one backside adhesive material 220 is designed to receive and retain the at least one frontside adhesive material 216 and the at least one customizable plushy accessory 210, as illustrated in FIG. 5, which is designed to attach to the at least one plushy stuffed animal 202.

In accordance with such preferred embodiment of the present invention, illustrated in FIG. 5, at least one garment of a deceased loved one 222 is provided by a bereaved person along with a pen 224 that is designed to place markings on the at least one garment of the deceased loved one 222. The DIY memorial kit system 200 includes at least one personalization template 226, which is shown in FIG. 5, that is largely formed in the shape of the at least one customizable plushy accessory 210 and a cutting tool 228 that is designed for shearing the at least one garment of the deceased loved one 222. The at least one garment of the deceased loved one 222 forms at least one pattern piece 230 that is in the shape of the at least one customizable plushy accessory 210 when sheared with the cutting tool 228, shown in FIG. 6D.

In accordance with the present invention, as illustrated in FIGS. 5 and 6C, the accessory front surface 212 includes a removable protective paper liner 232 that covers a heat activated permanent double-sided adhesive 234. As illustrated in FIG. 6D, the heat activated permanent double-sided adhesive 234 is designed to receive and retain the at least one pattern piece 230 when the at least one customizable plushy accessory 210 and the at least one pattern piece 230 are exposed to heat and pressure.

In one embodiment, as illustrated in FIGS. 7 and 8, the outer shell material 204 of the at least one plushy stuffed animal 202 is made of at least one of or a combination of the materials that include weatherproof and tear resistant material, felt, mohair, faux fur, cotton, fleece, corduroy, canvas, and jeans. Such options would be available as options upon purchase of the DIY memorial kit system 200.

In another embodiment, the inner stuffing material 206 is made out of at least one of or a combination of materials that include cotton, wool, down, beads, plastic pellets, beans, synthetic fiber, and bamboo fibers. Similarly, Such options would be available as options upon purchase of the DIY memorial kit system 200.

Turning to FIG. 7, in yet another embodiment, the DIY memorial kit system 200 further includes a weighted interior material 208 designed to provide anxiety relief to the bereaved person by increasing the weight of the at least one plushy stuffed animal 202. In accordance with such embodiment of the present invention the weighted interior material 208 is evenly distributed within the at least one plushy stuffed animal 202 providing anxiety relieving effects similar to those provided by weighted blankets. The weighted interior material 208 is made of at least one of or a combination of materials that include glass beads, plastic pellets, rice, buckwheat, and beans.

In one embodiment, as shown in FIG. 8, the DIY memorial kit system 200 further includes a weighted interior material 208 designed to provide anxiety relief to the bereaved person by increasing the weight of the at least one plushy stuffed animal 202. In accordance with such embodiment of the invention, the weighted interior material 208 is contained in at least one bag 236 that is sewn onto an interior surface 238 of the outer shell material 204. This provides a way of increasing the weight of the at least one plushy stuffed animal 202 in specific locations of the at least one plushy stuffed animal 202, which provides additional comfort to the bereaved person when cuddling with the at least one plushy stuffed animal 202. The weighted interior material 208 contained in the at least one bag 236 is made of at least one of or a combination of materials that include glass beads, plastic pellets, rice, buckwheat, sand, and beans.

In another embodiment, the at least one customizable plushy accessory 210 is an accessory that is optionally either a flower, star, square, rectangle, circle, oval, triangle, or heart. As an exemplary illustration of the present invention, the at least one customizable plushy accessory 210 is depicted as a flower such as that depicted in FIGS. 5-6D, however it would be apparent to one skilled in the relevant art that the at least one customizable plushy accessory 210 can be presented in various forms such as those presented above.

In yet another embodiment, shown in FIGS. 5 and 6B, the at least one backside adhesive material 220 and the at least one frontside adhesive material 216 are made of either Velcro® double sided adhesive glue, snap buttons, or hook-and-loop fasteners.

In one embodiment, as shown in FIGS. 5 and 6C-6D, the heat activated permanent double-sided adhesive 234 is made of at least one of or a combination of chemical components that include polyethylene terephthalate (PET), polyethylene vinyl acetate (EVA), polyamide (nylon), natural resins, synthetic resins, waxes, calcium carbonate, talc, silica, butylated hydroxytoluene (BHT), and butylated hydroxyanisole (BHA).

In accordance with embodiments of the invention, there is provided a method 300 for creating a DIY customized memorial plushy stuffed animal 300 comprises the components of the embodiments previously described above in detail in this specification.

Figure 9:
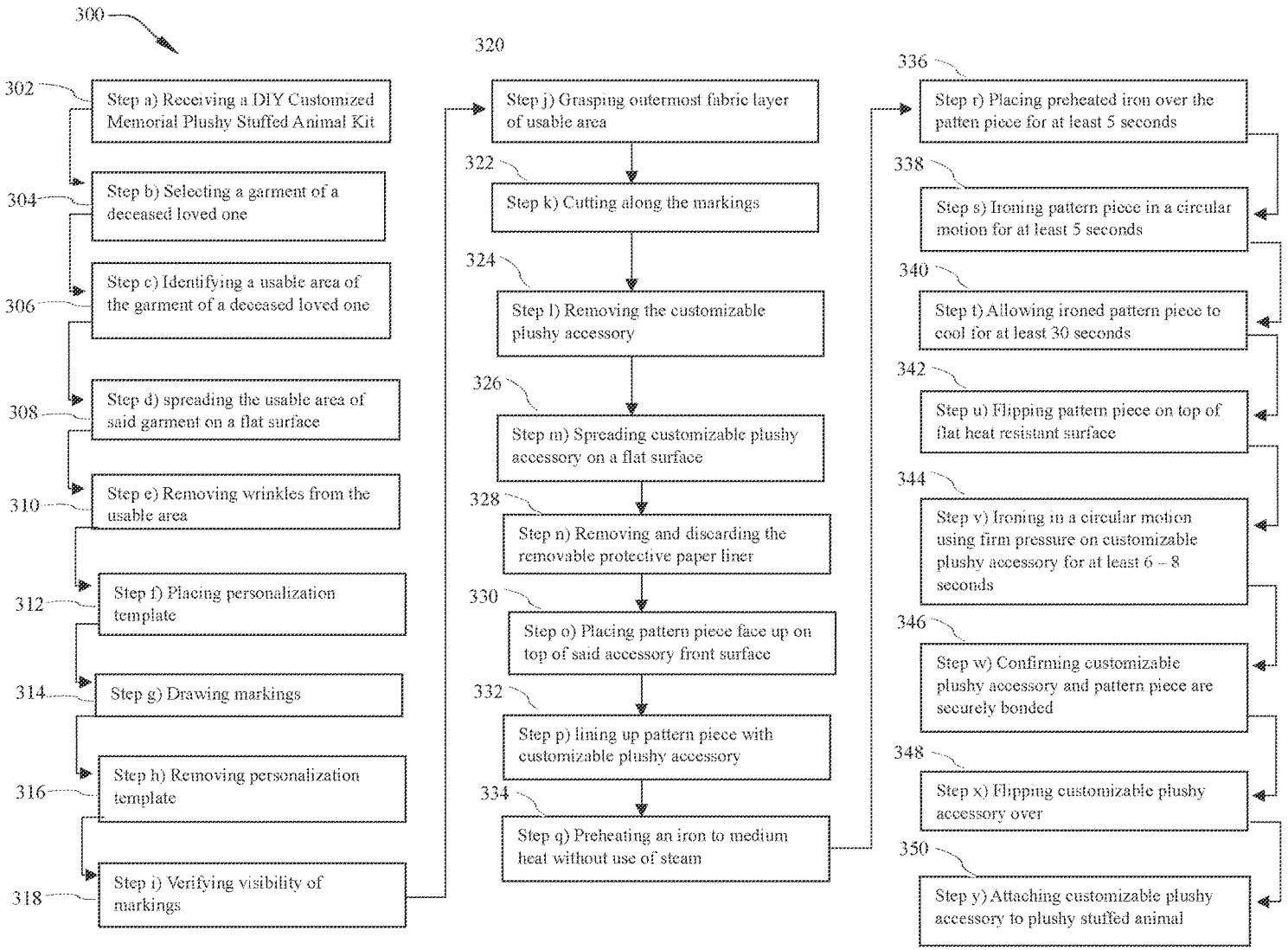
FIG. 9 an exemplary flowchart illustrating an exemplary method of creating a DIY customized memorial plushy stuffed animal in accordance with embodiments of the invention.

Now turning specifically to FIG. 9, the method of creating a DIY customized memorial plushy stuffed animal 300 includes step a) 301 of receiving a DIY customized memorial plushy stuffed animal kit. The DIY customized memorial plushy stuffed animal kit includes a plushy stuffed animal, a customizable plushy accessory including a removable protective paper liner that covers a heat activated permanent double-sided adhesive on an accessory front surface of the customizable plushy accessory, a personalization template that is significantly formed in the shape of the customizable plushy accessory, and a cutting tool, such as those described in the above specification. The method 300 includes a step b) 304 of selecting a garment of a deceased loved one for personalization that can safely be ironed followed by a step c) 306 of identifying a usable area of the garment which does not exhibit significant signs of wear or staining and does not include seams, buttonholes, or hardware.

Continuing to refer to FIG. 9, in accordance with the present method 300, the method 300 includes a step d) 308 of spreading the usable area of the garment of a deceased loved one over a flat surface, then a step e) 310 of removing wrinkles from the usable area of the garment of a deceased loved one by smoothing the usable area of the garment of a deceased loved one on the flat surface, and then a step f) 312 of placing the personalization template carefully and firmly on top of the usable area of the garment of a deceased loved one. A step g) 314 of drawing markings on the usable area of the garment of a deceased loved one using a pen that is provided by the bereaved person by trace around the outer edges of the personalization template, followed by a step h) 316 of removing the personalization template from the usable area of the garment of a deceased loved one, then a step i) 318 of verifying the visibility of the markings on the usable area of the garment of a deceased loved one, and a step j) 320 of grasping an outermost fabric layer of the usable area of the garment of a deceased loved one.

The method 300 then includes a step k) 322 of cutting along the markings on the usable area of the garment of a deceased loved one with the cutting tool to form a pattern piece, then a step l) 324 of removing the customizable plushy accessory from the plushy stuffed animal, followed by a step m) 326 of spreading the customizable plushy accessory on a flat heat resistant surface, and a step n) 328 of removing and discarding the removable protective paper liner from the accessory front surface.

Furthermore, in continuing to refer to FIG. 9, in accordance with the present invention, the method 300 includes a step o) 330 of placing the pattern piece face up on top of the accessory front surface, followed by a step p) 332 of lining up the pattern piece on top of the customizable plushy accessory to cover the entire area once covered by the protective liner, then a step q) 334 of preheating an iron to medium heat without the use of steam, and a step r) 336 of placing the preheated iron over the pattern piece lined up with the customizable plushy accessory for at least 5 seconds. The method 300 then includes a step s) 338 of ironing the pattern piece lined up with the customizable plushy accessory in a circular motion for at least 5 seconds, then a step t) 340 of allowing the ironed pattern piece lined up with the customizable plushy accessory to cool briefly for at least 30 seconds, and a step u) 342 of flipping the pattern piece lined up with the customizable plushy accessory on top of the flat heat resistant surface.

Still referring to FIG. 9, the method 300 then includes a step v) 344 of ironing in a circular motion using firm pressure on the customizable plushy accessory lined up with the pattern piece for at least six to eight seconds until the customizable plushy accessory and the pattern piece are securely bonded, followed by a step w) 346 of confirming that the customizable plushy accessory and the pattern piece are securely bonded. The method includes a step x) 348 of flipping the customizable plushy accessory securely bonded to the pattern piece over, and finally a step y) 350 of attaching the customizable plushy accessory securely bonded to the pattern piece to the plushy stuffed animal.

In one embodiment of the method 300, the at least one customizable plushy accessory 110 is an accessory that is optionally either a bandana bib, vest, dress, pants, skirt, shirt, jacket, scarf, hat, headband, or mask. As an exemplary illustration of the present invention, the at least one customizable plushy accessory 110 is depicted as a bandana bib such as that depicted in FIGS. 1-2D, however it would be apparent to one skilled in the relevant art that the at least one customizable plushy accessory 110 can be presented in various forms such as those presented above.

In another embodiment of the method 300, the at least one customizable plushy accessory 210 is an accessory that is optionally either a flower, star, square, rectangle, circle, oval, triangle, or heart. As an exemplary illustration of the present invention, the at least one customizable plushy accessory 210 is depicted as a flower such as that depicted in FIGS. 5-6D, however it would be apparent to one skilled in the relevant art that the at least one customizable plushy accessory 210 can be presented in various forms such as those presented above.

It will be apparent to persons skilled in the relevant art that various changes in form and detail can be made without departing from the spirit and scope of the invention. While various embodiments of the present invention have been described above, it should be understood that they have been presented by way of example only, and not limitation. Thus, the breadth and scope of the present invention should not be limited by any of the above-described exemplary embodiments, but should only be defined in accordance with the following claims and their equivalents. All patents and publications discussed herein are incorporated in their entirety by reference thereto.

The claimed invention is:

1. A DIY Memorial Kit system, comprising:

at least one plushy stuffed animal comprising an outer shell material and an inner stuffing material;

at least one customizable plushy accessory comprising an accessory front surface which comprises a first end section opposite an accessory back surface which comprises a second end section;

at least one frontside adhesive material adheredly disposed on the first end section of said accessory front surface;

at least one backside adhesive material adheredly disposed on the second end section of said accessory back surface;

wherein said at least one backside adhesive material adapted to receive and retain said at least one frontside adhesive material;

wherein said at least one customizable plushy accessory adapted to wrap around said at least one plushy stuffed animal;

at least one garment of a deceased loved one provided by a consumer of said DIY Memorial Kit system;

a pen provided by said consumer adapted to place markings on said at least one garment of the deceased loved one;

at least one personalization template substantially formed to a shape of the at least one customizable plushy accessory; and a cutting tool adapted for shearing the at least one garment of the deceased loved one;

wherein said at least one garment of the deceased loved one forms at least one pattern piece adapted to the shape of the at least one customizable plushy accessory when sheared with the cutting tool;

wherein said accessory front surface comprising a removable protective paper liner covering a heat activated permanent double-sided adhesive adapted to receive and retain said at least one pattern piece when the at least one customizable plushy accessory and the at least one pattern piece exposed to heat and pressure.

2. The system of claim 1, wherein the outer shell material of the at least one plushy stuffed animal comprises at least one element selected from the group consisting of weatherproof and tear resistant material, felt, mohair, faux fur, cotton, fleece, corduroy, canvas, and jeans.

3. The system of claim 1, wherein the inner stuffing material comprises at least one element consisting of cotton, wool, down, beads, plastic pellets, beans, synthetic fiber, and bamboo fibers.

4. The system of claim 1, further comprising a weighted interior material adapted to provide anxiety relief by increasing the weight of said at least one plushy stuffed animal;

wherein the weighted interior material is evenly distributed within said at least one plushy stuffed animal and comprises at least one element consisting of glass beads, plastic pellets, rice, buckwheat, and beans.

5. The system of claim 1, further comprising a weighted interior material adapted to provide anxiety relief by increasing the weight of said at least one plushy stuffed animal;

wherein the weighted interior material is contained in at least one bag sewn onto an interior surface of the outer shell material wherein the weighted interior material comprises at least one element consisting of glass beads, plastic pellets, rice, buckwheat, sand, and beans.

6. The system of claim 1, wherein the at least one customizable plushy accessory is an accessory selected from the group consisting of bandana bib, vest, dress, pants, skirt, shirt, jacket, scarf, hat, headband, and mask.

7. The system of claim 1, wherein the at least one backside adhesive material and the at least one frontside adhesive material comprises at least one element consisting of double sided adhesive glue, snap buttons, and hook-and-loop fasteners.

8. The system of claim 1, wherein the heat activated permanent double-sided adhesive comprises at least one element consisting of polyethylene terephthalate (PET), polyethylene vinyl acetate (EVA), polyamide (nylon), natural resins, synthetic resins, waxes, calcium carbonate, talc, silica, butylated hydroxytoluene (BHT), and butylated hydroxyanisole (BHA).

9. A DIY Memorial Kit system, comprising:

at least one plushy stuffed animal comprising an outer shell material and an inner stuffing material;

at least one customizable plushy accessory comprising an accessory front surface opposite an accessory back surface;

at least one frontside adhesive material disposed on a plushy front surface of the at least one plushy stuffed animal;

at least one backside adhesive material disposed on the backside of the accessory back surface;

wherein said at least one backside adhesive material adapted to receive and retain said at least one frontside adhesive material and said at least one customizable plushy accessory adapted to adhere to said at least one plushy stuffed animal;

at least one garment of a deceased loved one provided by a consumer of said DIY Memorial Kit system;

a pen provided by said consumer adapted to place markings on said at least one garment of the deceased loved one;

at least one personalization template substantially formed to a shape of the at least one customizable plushy accessory; and a cutting tool adapted for shearing the at least one garment of the deceased loved one;

wherein said at least one garment of the deceased loved one forms at least one pattern piece adapted to the shape of the at least one customizable plushy accessory when sheared with the cutting tool;

wherein said accessory front surface comprising a removable protective paper liner covering a heat activated permanent double-sided adhesive adapted to receive and retain said at least one pattern piece when said at least one pattern piece exposed to heat and pressure.

10. The system of claim 9, wherein the outer shell material of the at least one plushy stuffed animal comprises at least one element selected from the group consisting of weatherproof and tear resistant material, felt, mohair, faux fur, cotton, fleece, corduroy, canvas, and jeans.

11. The system of claim 9, wherein the inner stuffing material comprises at least one element consisting of cotton, wool, down, beads, plastic pellets, beans, synthetic fiber, and bamboo fibers.

12. The system of claim 9, further comprising a weighted interior material adapted to provide anxiety relief by increasing the weight of said at least one plushy stuffed animal;

wherein the weighted interior material is evenly distributed within said at least one plushy stuffed animal and comprises at least one element consisting of glass beads, plastic pellets, rice, buckwheat, and beans.

13. The system of claim 9, further comprising a weighted interior material adapted to provide anxiety relief by increasing the weight of said at least one plushy stuffed animal;

wherein the weighted interior material is contained in at least one bag sewn onto an interior surface of the outer shell material wherein the weighted interior material comprises at least one element consisting of glass beads, plastic pellets, rice, buckwheat, sand, and beans.

14. The system of claim 9, wherein the at least one customizable plushy accessory is an accessory shaped in the form selected from the group consisting of flower, star, square, rectangle, circle, oval, triangle, and heart.

15. The system of claim 9, wherein the at least one backside adhesive material and the at least one frontside adhesive material comprises at least one element consisting of double sided adhesive glue, snap buttons, and hook-and-loop fasteners.

16. The system of claim 9, wherein the heat activated permanent double-sided adhesive comprises at least one element consisting of polyethylene terephthalate (PET), polyethylene vinyl acetate (EVA), polyamide (nylon), natural resins, synthetic resins, waxes, calcium carbonate, talc, silica, butylated hydroxytoluene (BHT), and butylated hydroxyanisole (BHA).

17. A Method of Creating a DIY Customized Memorial Plushy Stuffed Animal, comprising the steps of:

a) receiving a DIY customized memorial plushy stuffed animal kit comprising a plushy stuffed animal, a customizable plushy accessory comprising a removable protective paper liner covering a heat activated permanent double-sided adhesive on an accessory front surface of the customizable plushy accessory, a personalization template substantially formed to a shape of the customizable plushy accessory, and a cutting tool;

b) selecting a garment of a deceased loved one for personalization that can safely be ironed;

c) identifying a usable area of said garment of a deceased loved one which does not exhibit significant signs of wear or staining and does not include seams, buttonholes, or hardware;

d) spreading the usable area of said garment of a deceased loved one over a flat surface;

e) removing wrinkles from the usable area of said garment of a deceased loved one by smoothing the usable area of said garment of a deceased loved one on the flat surface;

f) placing the personalization template carefully and firmly on top of the usable area of said garment of a deceased loved one;

g) drawing markings on the usable area of said garment of a deceased loved one using a pen provided by a consumer of the DIY customized memorial plushy stuffed animal kit by trace around the outer edges of the personalization template;

h) removing the personalization template from the usable area of said garment of a deceased loved one;

i) verifying the visibility of the markings on the usable area of said garment of a deceased loved one;

j) grasping an outermost fabric layer of the usable area of said garment of a deceased loved one;

k) cutting along the markings on the usable area of said garment of a deceased loved one with the cutting tool to form a pattern piece;

l) removing the customizable plushy accessory from said plushy stuffed animal;

m) spreading the customizable plushy accessory on a flat heat resistant surface;

n) removing and discarding the removable protective paper liner from the accessory front surface;

o) placing the pattern piece face up on top of the accessory front surface;

p) lining up the pattern piece on top of the customizable plushy accessory to cover the entire area once covered by the protective liner;

q) preheating an iron to medium heat without the use of steam;

r) placing the preheated iron over the pattern piece lined up with the customizable plushy accessory for at least 5 seconds;

s) ironing the pattern piece lined up with the customizable plushy accessory in a circular motion for at least 5 seconds;

t) allowing the ironed pattern piece lined up with the customizable plushy accessory to cool briefly for at least 30 seconds;

u) flipping the pattern piece lined up with the customizable plushy accessory on top of the flat heat resistant surface;

v) ironing in a circular motion using firm pressure on the customizable plushy accessory lined up with the pattern piece for at least six to eight seconds until the customizable plushy accessory and the pattern piece are securely bonded;

w) confirming that the customizable plushy accessory and the pattern piece are securely bonded;

x) flipping the customizable plushy accessory securely bonded to the pattern piece over; and y) attaching the customizable plushy accessory securely bonded to the pattern piece to the plushy stuffed animal.

18. The method of claim 17, wherein the at least one customizable plushy accessory is an accessory selected from the group consisting of bandana bib, vest, dress, pants, skirt, shirt, jacket, scarf, hat, headband, and mask.

19. The method of claim 18, wherein the at least one customizable plushy accessory is an accessory shaped in the form selected from the group consisting of flower, star, square, rectangle, circle, oval, triangle, and heart.

* * * * *